United States Patent [19]

Pingon

[11] 4,030,701

[45] June 21, 1977

[54] PNEUMATIC VEHICLE JACK

[76] Inventor: Pierre Joseph Pingon, 7 avenue du Parmelan, 74 Annecy (Haute Savoie), France

[22] Filed: Apr. 6, 1976

[21] Appl. No.: 674,736

[30] Foreign Application Priority Data

Apr. 11, 1975 France ..... 75.11343
Dec. 12, 1975 France ..... 75.38064

[52] U.S. Cl. ..... 254/124
[51] Int. Cl.[2] ..... B66F 3/24
[58] Field of Search ..... 254/93 R, 93 H, 93 HP, 254/124, 126

[56] References Cited

UNITED STATES PATENTS

| | | | |
|---|---|---|---|
| 1,492,159 | 4/1924 | Caretta | 254/93 HP |
| 1,590,830 | 6/1926 | Jewkes | 254/93 HP |
| 1,638,859 | 8/1927 | Knowles | 254/126 |
| 2,341,278 | 2/1944 | Long | 254/93 H |
| 2,606,469 | 8/1952 | Morgenthaler | 254/126 |

*Primary Examiner*—Al Lawrence Smith
*Assistant Examiner*—Robert C. Watson
*Attorney, Agent, or Firm*—Young & Thompson

[57] ABSTRACT

A pneumatic vehicle jack comprises a jack cylinder with a body and a piston rod assembly movable relative to each other, two levers pivoted to said body or piston rod assembly, located on either side of the longitudinal axis of the jack cylinder and carrying vehicle and ground engaging shoes, and two struts pivotally mounted between said levers on the one hand and said piston rod assembly or cylinder body on the other hand. A cartridge of compressed gas can be removably connected to said jack cylinder for actuating the same. Actuation of the jack cylinder causes the pivot points of the levers and struts to be brought closer together, to move the shoes away from each other. At the beginning stage of the actuation movement, the lever system comprising the levers and struts reduces the force exerted by the jack, and at the end of the said movement it increases said force. Because the volume occupied by the gas contained in the cartridge increases during the actuation of the jack, the force exerted by the jack cylinder progressively decreases. Thus, the lever system compensates for this decreasing force and a substantially constant force is exerted by the vehicle jack over its whole stroke, and the raising movement of the vehicle is also progressive and constant.

9 Claims, 6 Drawing Figures

I
I
II
II

PNEUMATIC VEHICLE JACK

GENERAL DISCLOSURE

This invention relates to vehicle jacks.

Usually, vehicle jacks have screws or toothed racks acting upon levers, generally linked together, subsequently transmitting their forces to the vehicle. These screws or toothed racks are moved by mechanical parts such as cranks which take their energy from the user of the jack. (French Patent No. 718,235 and U.S. Pat. No. 1,544,997). Because of the low mechanical output of the screw-nut or screw-toothed rack system, the use of these jacks requires relatively large effort, and the jacks themselves are often cumbersome, heavy, dirty and difficult to use.

In order to overcome these disadvantages, jacks have been proposed which in use are actuated by a compressed gas cartridge (French Patents Nos. 552,926, 737,893, 1,427,118 and 70–23296 and U.S. Pat. No. 3,523,679). Nevertheless, these jacks have hitherto been made in the form of simple or compound jack cylinders or a bellows, of which the parts which move relative to one another under the action of the gas coming from the cartridge are placed directly between the surface forming the support and the vehicle to be lifted.

Now, to be usable in practice, a pneumatic jack must be actuated by a cartridge of relatively small size, and thus having a limited volume of compressed gas, and it should moreover provide a progressive and as far as possible a steady lifting movement of the vehicle, whilst the compressed gas in the cartridge expands in the volume of the jack cylinder as the latter extends, and consequently supplies a force varying from a high value at the beginning of the movement to a low value towards the end of the lifting, when the volume of the jack cylinder reaches a maxiumum.

In addition such a jack should be of small size, particularly in height, in the folded position, in order tht it can be inserted without difficulty under the frame of a vehicle with a flat tyre, and it should be easy to handle and position.

One object of the invention is to create a pneumatic vehicle jack which overcomes the disadvantages of jacks which use the above principle, and which fulfils those conditions.

Another object of the invention is to provide a pneumatic vehicle jack comprising, in combination, a pneumatic jack cylinder, a cartridge of compressed air having a limited volume, the interior of which can be connected to the pressure chamber of the cylinder for operating the jack, whereby the force exerted by the jack cylinder is reduced progressively when the volume of its pressure chamber increases during the operation of the jack, and a lever system connected to the movable parts of the jack cylinder, acting between the ground or other supporting surface and the vehicle to be lifted, and arranged for reducing the force provided by the jack cylinder at the beginning stage of the operation of the jack and for multiplying said force during the last stage of the operation, in order that a substantially constant lifting force is obtained from the vehicle jack.

Still another object is to provide a pneumatic vehicle jack comprising a jack cylinder consisting of two parts movable relative to one another and forming the body and the piston rod assembly of the jack cylinder, two levers pivoted to one part of the jack cylinder and situated on either side of the longitudinal axis of the said jack cylinder and carrying shoes for engaging a support surface and a vehicle to be lifted, two struts pivoted on the one hand to the other part of the jack cylinder and on the other hand to each lever, means for the detachable fitting of a cartridge of compressed gas on one part of the jack, and means for connecting the interior of a gas cartridge to the chamber of the jack cylinder for the operation of the jack, the arrangement being such that operation of the jack cylinder causes the pivot points of the levers and struts with respective parts of the jack cylinders to be brought closer together which, through the action of the struts causes the levers to be pivoted away from one another.

By giving the operating levers a U-shaped right angled section so that the operating levers, when in the folded position, surround the jack cylinder, a compact unit may be obtained of small height and in which the more fragile movable parts, such as the piston rod of the jack cylinder or the struts, and also the pivot points are protected.

When the jack is actuated, the force of the jack cylinder is transmitted by the struts to the operating levers, causing them to move apart by the drawing together of the pivot points of these operating levers and of the struts on the parts of the jack cylinder. In the folded position, the struts form an acute angle with one another, and they then act on the operating levers in these conditons as a weak lever arm or mechanical advantage in relation to the pivot points of these levers on the jack cylinder, so that the lifting force of the jack represents only a small part of the force of the jack cylinder. When the jack expands, the angle between the struts opens out, and the force of the jack cylinder is then transmitted by the struts to the levers with the shoes in an amplified manner, as a result of the efficient lengthening of the lever arm. On the other hand, given that the compressed air in the cartridge occupies an increasing volume in the jack cylinder, the force of the jack cylinder lessens as the jack expands. As a result of the above indicated condition, a more uniform lifting force is provided by the jack.

In order to facilitate the handling of the jack, the body of the jack cylinder may, according to one form of the invention, be tubular in shape and project at one side to make a handle, making the positioning of the jack easier, the compressed air cartridge being fitted into this tubular shaped jacking cylinder.

Figures 1, 2:
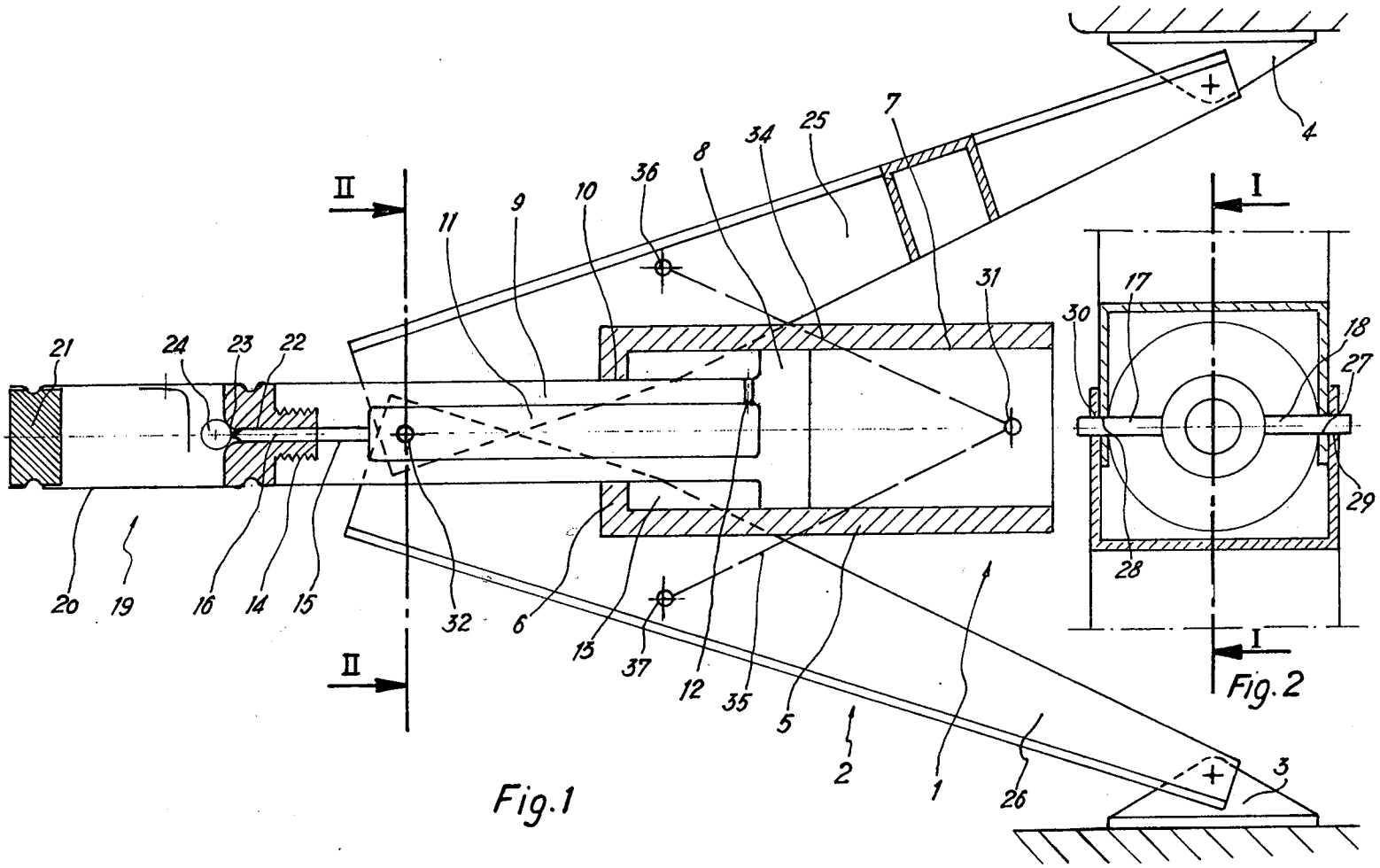
FIG. 1 is a view in section, along line I—I in FIG. 2, of one possible form of the jack according to the invention.
FIG. 2 is a view of the end of the jack shown in FIG. 1, along the line II—II in FIG. 1.

According to the form of the invention shown in FIG. 1 and FIG. 2, the jack comprises a motive part 1 linked with a part marked 2 which ensures the transmission of the forces developed in the said motive part 1 between the support surface, contacted by the shoe 3 and the vehicle to be lifted, contacted by the shoe 4.

The motive part 1 comprises essentially a one-way jack cylinder consisting of a cylindrical tubular element 5 fitted with a base 6 at one of its ends. Within this tubular element, and sliding against its inner wall 7, moves a piston 8 together with a piston rod 9, which slides making a tight seal in a cylindrical opening 10 in the base 6. Along almost the entire length of the piston rod 9 is a bore 11. A hole 12 near the region of the junction of the piston rod 9 with the piston 8, makes communication between the axial bore 11 of the piston rod 9 and the working chamber 13 of the jack cylinder possible. The left hand end (looking at FIG. 1) of the piston rod 9 has a cylindrical threaded hole 14 whose purpose will be described later. Also at the left hand end, the bore 11 is extended by means of a passage 15, within which is fixed a hollow needle 16 forming a plunger, whose purpose will likewise be described later. The usual sealing methods ensure sealing of the fluid pressure system at all points.

On either side of the piston rod 9 near the left hand end are provided pins 17 and 18 which are made integral with the rod by soldering, brazing or other methods, thus forming a pivot axis 32 perpendicular to the axis of the piston rod 9.

A cartridge 19 formed by a cylindrical metal tube 20 is sealed at both ends (looking at FIG. 1) by two stoppers 21 and 22 respectively. These latter may be of plastics material and are inset into the tube. Inside the cartridge is air under high pressure. In the central part of the right hand stopper 22 is a cylindrical bore, which widens out towards the interior of the cartridge at 23 to form a seat for a ball-bearing valve 24. The ball valve 24 is able to bear against the surface of the bore at this point 23 in order to seal the bore placing the pressurised cartridge chamber out of communication with the outside. The face of the right hand stopper 22 that is directed outwards is extended by a threaded boss, which will screw into the corresponding threaded hole 14 at the left hand end of the piston rod 9.

The forces supplied by the jack cylinder are transmitted to the vehicle by the part marked 2 of the jack. The part 2 comprises principally two levers 25 and 26 each pivoting, on the one hand, at their common end, about the axis 32 as defined by the pins 17 and 18, and on the other hand, at a point distant from the aforesaid end, at the end of the small struts 34,35 which are themselves pivoted by their other end about axis 31 on the body 5 of the jacking cylinder.

These levers 25 and 26 have a general section in the form of a U and are made of bent sheet metal. The spacing of the limbs of the U are not equal in order to permit the nesting of the first lever 25 between the limbs of the U of the second lever 26. The ends of these levers pivoted about the axis 32 are fitted onto the pins 17,18 by means of the holes 27 and 28, 29 and 30. The back of the levers is directed outwards so as to enclose the body of the jack cylinder between the parallel limbs of the U-shaped levers.

The small struts 34 and 35 may be of any type. They are suitably pivoted on the pins 31 of the body 5 of the jacking cylinder. The pivot points 36,37 of these small struts on the U-section levers, the length of the small struts and the positions of the axes 31 and 32 are contrived in order to provide a suitable geometry for the use envisaged.

The shoes 3 and 4 are likewise mounted on pivots at the right hand ends (on the diagram) of the levers, so that they may engage against the vehicle to be raised on the one hand, and on the support surface or ground on the other.

The jack functions as follows:

When a cartridge of compressed air is screwed onto the end of the piston rod, the hollow needle 16 separates the ball bearing 24 from its seating, thus connecting the inside of the cartridge with the chamber 13 of the jack cylinder via the bore 11 and the passage 12. Thus the piston moves relative to the body of the jack cylinder. When this movement occurs tending to reduce the distance between the two pivot axes 31 and 32, the levers 25 and 26 pivot and their right hand ends move away from each other. As a result of this separation, the distance between the shoes 3 and 4 increases, raising the vehicle. It will be realised that the pneumatic system formed by the cartridge and the chamber of the piston is a closed system which maintains the vehicle in raised position.

Figure 3:
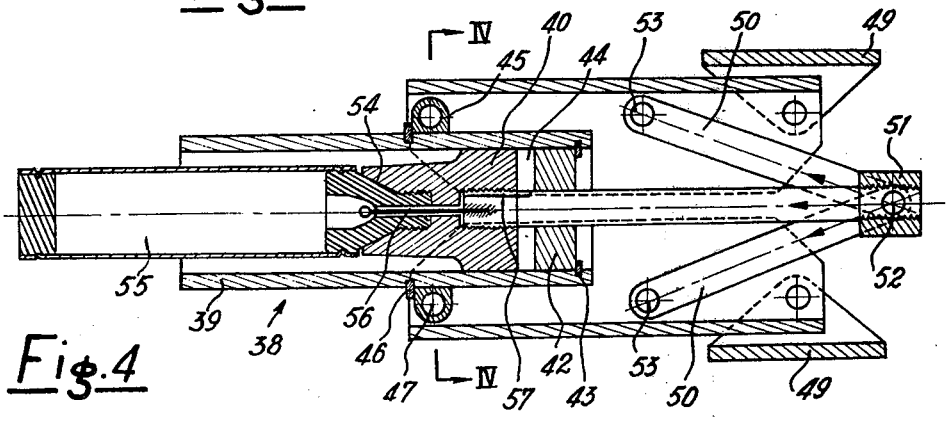
FIG. 3 is a longitudinal section of a preferred form of the jack according to the invention, the jack being at rest.
Figure 4:
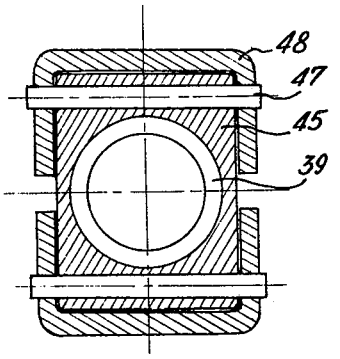
FIG. 4 is a transverse section along the line IV—IV in FIG. 3.
Figure 5:
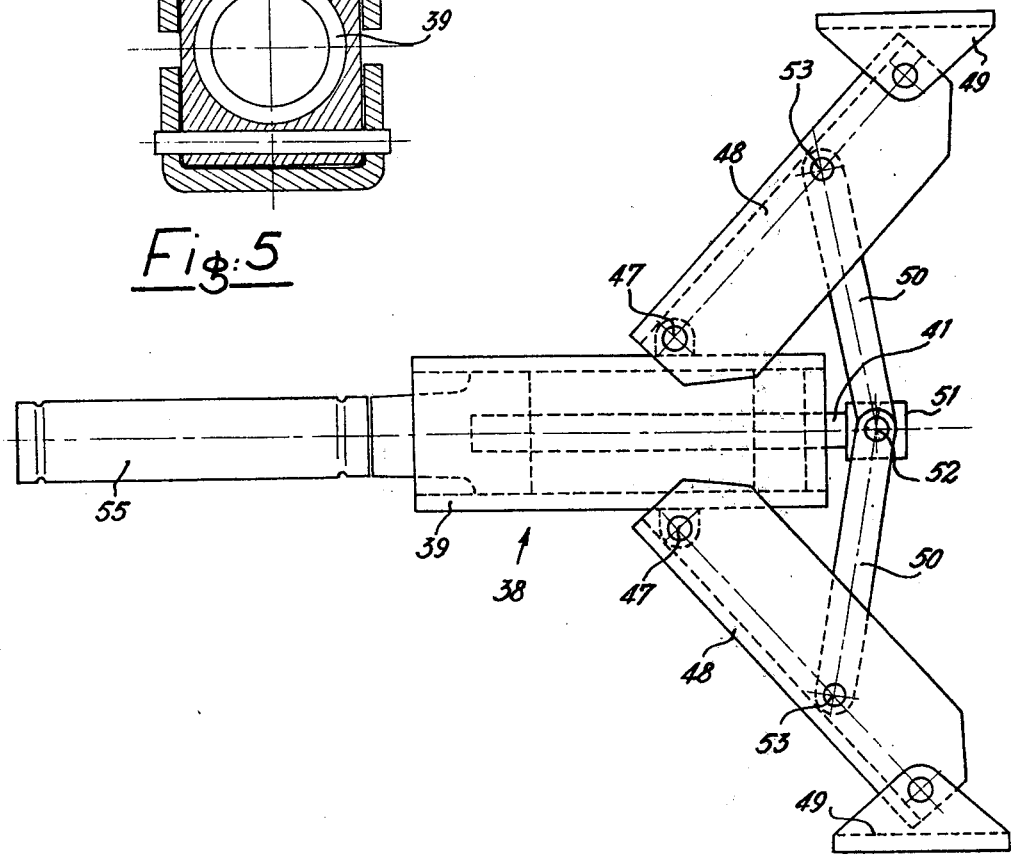
FIG. 5 is an elevation of the jack shown in FIG. 3, in expanded position.

The preferred form of the invention shown in FIGS. 3 to 5 comprises a jack cylinder 38 provided with a body 39 into which slides a piston 40 having a piston rod 41. The body 39 of the jack is formed from a tubular part which is closed at one end by a base 42 secured by a stop ring 43, the chamber 44 of the jack cylinder being created between the base 42 and the piston 40. The rod 41 of the piston is screw-fitted into the piston.

The body 39 of the jack cylinder has a rectangular block 45, better shown in FIG. 4, secured by a stop ring 46. This block is traversed by the pivot axles 47 perpendicular to the longitudinal axis of the jack cylinder, on which are pivoted the operating levers 48 having a generally U-shaped cross section, the open sides of the levers being opposed to create, when folded together a rectangular housing in which are placed the parts of the jack, as shown in FIG. 3. At their ends opposite to the axles 47, the levers 48 have shoes 49 for the purpose of acting between the ground and the vehicle to be raised.

Struts 50 are pivoted on the one hand on a part 51 screwed to the free end of the piston rod, by means of an axle 52, and on the other hand on the operating levers 48, by the axles 53.

As can be seen in FIGS. 3 and 5, the body 39 of the jack cylinder extends beyond the pivot block 45 of the levers 48, away from the piston rod, so as to form a handle making it possible to hold the jack when it is in use.

Within the case formed by this handle, the piston 40 provides a housing 54 which has a threaded section into which can be screwed a cartridge of compressed air 55 for the purpose of operating the jack.

At the end of the piston rod nearest the piston is a needle 56 which, when the cartridge 55 is put in place, actuates the valve of this cartridge, to admit compressed air into the jack cylinder. A channel 57 in the piston rod 41 establishes communication between the needle 56 and the chamber 44 of the jack cylinder.

The operation of this particular form of jack according to the invention is similar to that of the jack described above.

In the starting position shown in FIG. 3, the operating levers are virtually parallel and closed about the parts of the jack, protecting them. Thus the jack is of minimal height, which makes it easier to position beneath the vehicle. The piston rod of the jack cylinder is in the extended position and the separation between the axles 52 and 47 is at maximum. The handle formed by the body 39 of the jack cylinder 38 facilitates the positioning of the jack beneath the vehicle.

When the cartridge of compressed air is screwed into place, communication is made between this cartridge and the chamber 44 of the jack cylinder. The pressurising of this chamber 44 causes the piston 40 of the jack cylinder to move to the left, looking at FIG. 3.

The forces exercised by the piston rod 41 on the pivot axis 52 and on the struts 50 are shown by arrows on FIG. 3. At the beginning of the operation, the force supplied by the jack cylinder is at a maximum, as is the pull exerted on the axle 52. This force is transmitted to the struts 50. However, it acts on the operating levers 48 via a lever arm or mechanical advantage which is very short relative to the pivot axles 47 of these levers on the body of the jack cylinder. Under these conditions, the resultant lifting force of the jack is less than that supplied by the jack cylinder.

As the jack expands, the effective lever arms via which the struts act on the operating levers increase, and the resultant lifting force of the jack approaches that of the jack cylinder itself, and then surpasses it as the final expanded position of the jack shown in FIG. 5 is neared.

But given that the volume occupied by the compressed air from the cartridge 55 increases, since the volume is made up of the sum of the volumes of the cartridge and the chamber 44, the force of the jack cylinder itself descreases. Thus, the mechanical advantage of the jack and the force of the jack cylinder itself vary in opposite directions, and as a result of this, a virtually constant resultant lifting force is achieved for the jack, and consequently an appreciably uniform lifting movement of the vehicle.

Examination of FIG. 5 will show that a jack thus contructed has a considerable height when in the expanded position, and that the lifting path which results from the difference in heights between the rest position shown in FIG. 3 and the operating position shown in FIG. 5, is itself of notable extent.

Figure 6:
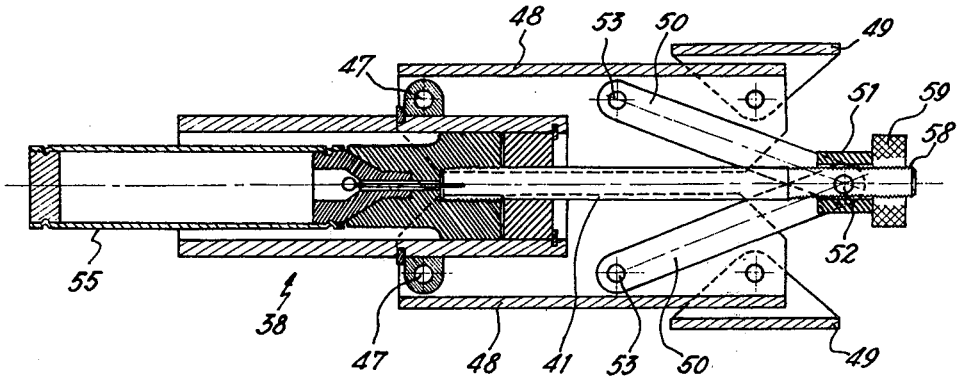
FIG. 6 is a view similar to FIG. 3 but showing a modified embodiment.

In the embodiment shown in FIG. 6, the right end part of piston rod 41 is threaded at 58 and the ring 51 carrying the pivots for the struts 50 is freely slidable on said piston rod and is in an abutment relationship with a threaded ring 59 having a knurled outer surface and in screwed engagement with the threaded portion of said piston rod 41.

Consequently, when the vehicle jack is engaged under a vehicle having a flat tyre, screwing of the nut 59 onto said threaded portion 58 moves the ring 51 to the left when looking at FIG. 6, so that the struts 50 open the levers 48. This screwing operation brings the upper shoe 49 against the vehicle body, while the lower shoe 49 is resting on the ground. The cartridge 55 can then be screwed into the piston 40 in order to operate the jack.

It will be understood that screwing of the nut onto the piston rod threaded portion moves the levers 48 without any displacement of the piston rod or the piston within the cylinder. Consequently, the cylinder chamber remains at a minimum volume and the volume of the gas cartridge can thus be reduced without any loss of lifting power for the jack. This results from avoiding any lost motion between the shoes 49 and the vehicle to be lifted.

What is claimed is:

1. A pneumatic vehicle jack comprising a pneumatic jack cylinder made of relatively movable parts and having a pressure chamber, a cartridge of compressed air having a limited volume, means for connecting the interior of said cartridge with said pressure chamber of said jack cylinder, whereby the force exerted by said jack cylinder is progressively reduced when the volume of said pressure chamber increases during the operation of said jack, and a lever system connected to said movable parts of said jack cylinder and acting between the ground and the vehicle to be lifted, said lever system comprising levers so disposed as to reduce the force exerted by the jack cylinder at the beginning stage of the jack operation and for multiplying said force during the last stage of the said operation, so that a substantially constant lifting force is provided by said vehicle jack.

2. A pneumatic vehicle jack comprising a jack cylinder having two relatively movable parts forming a body and a piston rod assembly for said jack cylinder, said piston rod assembly having a piston slidably mounted in said body and a piston rod extending outside said body, two levers pivoted at pivot points on said body, said levers being arranged on either side of the longitudinal axis of said jack cylinder, ground and vehicle engaging shoes on said levers, two struts pivoted at pivot points on said piston rod at its end opposite said piston on the one hand, and to each lever on the other hand, means on said piston on its side opposite said piston rod for removably fitting a cartridge of compressed gas, and means for connecting the interior of said gas cartridge with the interior of said jack cylinder so as to move said body and piston rod assembly relative to each other thereby to pivot said levers away from one another to actuate the jack.

3. A pneumatic vehicle jack according to claim 2, wherein said levers are substantially parallel to each other in the collapsed condition of the jack, said levers having a U-shaped cross-section with open sides directed toward each other and enclosing said jack cylinder and said struts in a box-like manner when said jack is in its closed condition.

4. A pneumatic vehicle jack according to claim 2, comprising a rectangular block member on said jack cylinder body, said levers being pivoted on said rectangular block member, and said struts being pivoted between said levers and said piston rod assembly.

5. A pneumatic vehicle jack according to claim 2, comprising a housing in said piston on its side opposite said piston rod, said cartridge of compressed gas being fittable within said housing, and passages in said piston between said housing and the interior of said jack cylinder for the operation of the jack through said compressed gas.

6. A pneumatic vehicle jack according to claim 2, comprising a tubular jack cylinder body projecting from said piston on the side opposite said piston rod and beyond said pivot points of said levers on said jack cylinder body, to provide a handle allowing the jack to be held when it is positioned under a vehicle to be lifted, and a housing in said piston on its side opposite said piston rod for receiving said cartridge of compressed gas, said tubular jack cylinder body surrounding said piston housing.

7. A pneumatic vehicle jack according to claim 2, comprising a housing in said piston on its side opposite said piston rod, said cartridge of compressed gas being fittable within said housing, passages in said piston between said housing and the interior of said jack cylinder for the operation of the jack through said compressed gas, there being a threaded portion on said piston rod at its end opposite said piston, a ring freely slidable on said threaded portion of said piston rod, said levers being pivoted on said piston cylinder, and said struts being pivotally mounted between said levers and said slidable ring, and an abutment nut screwed on said threaded portion of said piston rod for abutting and adjusting said slidable ring and the starting position of said vehicle jack.

8. A pneumatic vehicle jack comprising a jack cylinder having two relatively movable parts forming a body and a piston rod assembly for said jack cylinder, said piston rod assembly having a piston slidably mounted in said body and a piston rod extending outside said body and having a free end, two levers pivoted at pivot points at said free end of said piston rod, said levers being arranged on either side of the longitudinal axis of said jack cylinder, ground and vehicle engaging shoes on said levers, two struts pivoted at pivot points on said cylinder body on the one hand and to each lever on the other hand, means at the free end of said piston rod for removably fitting a cartridge of said compressed gas, and means for connecting the interior of said gas cartridge with the interior of said jack cylinder so as to move said body and piston rod assembly relative to each other thereby to pivot said levers away from one another to actuate the jack.

9. A pneumatic vehicle jack according to claim 8, comprising a longitudinal passage in said piston rod for connecting the interior of said compressed gas cartridge with the interior of said jack cylinder for operating the jack.

* * * * *